10/15/85 XR 4,546,522

United States Patent [19]

Gygax

[11] Patent Number: 4,546,522

[45] Date of Patent: Oct. 15, 1985

[54] RELEASABLE HINGE FOR A BRACELET

[75] Inventor: Claude-André Gygax, Evilard, Switzerland

[73] Assignee: Omega SA, Bienne, Switzerland

[21] Appl. No.: 625,163

[22] Filed: Jun. 27, 1984

[30] Foreign Application Priority Data

Jul. 11, 1983 [FR] France ..... 83 11918

[51] Int. Cl.[4] ..... A44C 5/08

[52] U.S. Cl. ..... 24/71 J; 24/70 J; 24/265 WS; 16/386; 16/267

[58] Field of Search ..... 24/71 J, 70 J, 68 J, 24/265 WS, 188, 685, 237, 116 A, 299; 63/5; 16/266, 267, 379, 386

[56] References Cited

U.S. PATENT DOCUMENTS

| | | | |
|---|---|---|---|
| 1,970,041 | 8/1934 | Johnson | 63/5 |
| 2,455,302 | 11/1948 | Gotti et al. | 24/71 J |
| 2,677,147 | 5/1954 | Phillips | 16/266 |
| 3,042,277 | 7/1962 | Stradella | 24/265 WS |
| 3,233,277 | 2/1966 | Hirashiki | 16/386 |
| 3,685,106 | 8/1972 | Gandelman | 24/265 WS |
| 4,315,345 | 2/1982 | Schijf | 16/267 |
| 4,379,360 | 4/1983 | Papsdorf | 16/386 |

FOREIGN PATENT DOCUMENTS

| | | | |
|---|---|---|---|
| 2748185 | 7/1982 | Fed. Rep. of Germany | 16/266 |

*Primary Examiner*—Victor N. Sakran

*Attorney, Agent, or Firm*—Griffin, Branigan, & Butler

[57] ABSTRACT

A hinge (7) is used to join two parts (5, 6) of a band or bracelet, the hinge enabling the parts to be attached and detached when the parts are positioned at a predetermined angle relative to each other. The first part (6) comprises an assembly formed of a pin (10) and a first cradle (11) which partially surrounds the pin, with which it is coaxial, wherein a space (12) is provided between the pin and the first cradle. The second part comprises a second cradle (14) which is designed to slide into the space (12) and to be articulated around the pin to keep the two parts attached together within a given angular range. The invention may be employed on a folding clasp of a band for a wristwatch.

7 Claims, 9 Drawing Figures

RELEASABLE HINGE FOR A BRACELET

BACKGROUND OF THE INVENTION

The invention relates to a hinge which is used to join two parts of a bracelet, and is arranged so that the two parts may be attached or detached.

In order to hold around the wrist, a bracelet's circumference must be reduced to prevent it from slipping onto the hand. In order to remove the bracelet from the wrist, it may fitted either with a clasp to detach it into two parts, or with an extendible device that allows it to expand to slip it freely over the hand.

It has been determined that it is preferable for the bracelet to be detachable into two parts to make it easier to transport or to display in a showcase, for example. Thus, the German disclosure No. GM 75 07 948 entitled "A Folding Clasp for a Band for a Wristwatch" discloses a device comprising a first part which forms a frame and a second part in the form of a plate, wherein the second part slides into the first part, and wherein the parts may be detached from each other by activating a small, elastic restraining tab. However, the disadvantage of this device is that it takes up space, adding thickness to the bracelet, and that it is more complicated to manufacture.

To obviate these disadvantages, this invention provides for a new form of detachable hinge for bracelets, implemented according to the method disclosed in the claims, wherein the hinge is particularly well adapted for use in a watchband.

BRIEF DESCRIPTION OF THE DRAWINGS

The invention shall be more clearly described in the following text and is illustrated in the attached drawings, provided as non-limiting examples wherein.

BRIEF DESCRIPTION OF THE INVENTION

In accordance with the principles of the present invention a hinge, used to join two parts of a bracelet so as to enable the two parts to be attached or detached, is characterized in that the first part comprises at least one assembly formed of a pin and a cradle which surrounds the pin with which it is coaxial, a space being provided between the pin and cradle, the second part comprising at least one second cradle which slides into the space to become articulated onto the pin and secure the two parts to each other within a given range of angles, the second cradle being designed to be inserted into or removed from the space when the two parts reach a certain angular position relative to each other.

In a preferred embodiment the first part comprises two assemblies, each of which is formed of a pin and a first cradle, and the second part comprises two second cradles.

DETAILED DESCRIPTION OF THE INVENTION

Figure 1A:
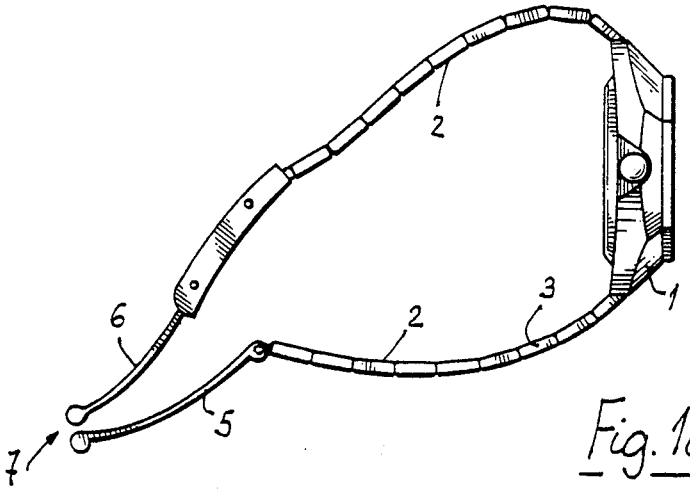
FIG. 1*a* shows the watch band or bracelet with its folding clasp in the detached position.
Figure 2A:
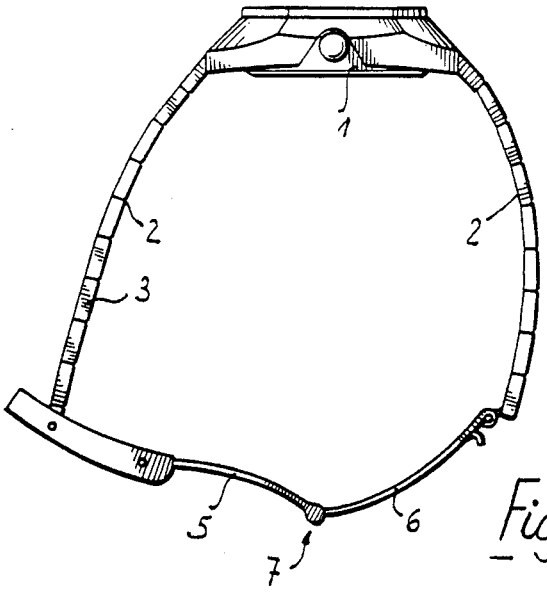
FIGS. 2*a*, 2*b* and 2*c* show the same illustrations as FIGS. 1*a*, 1*b* and 1*c*, respectively except that the parts forming the hinge are in the attached position and the bracelet is open; and, FIGS. 3*a*, 3*b* and 3*c* show the same illustrations as FIGS. 2*a*, 2*b* and 2*c*, respectively except that the parts forming the hinge are in the attached position and the bracelet is closed.
Figure 3A:
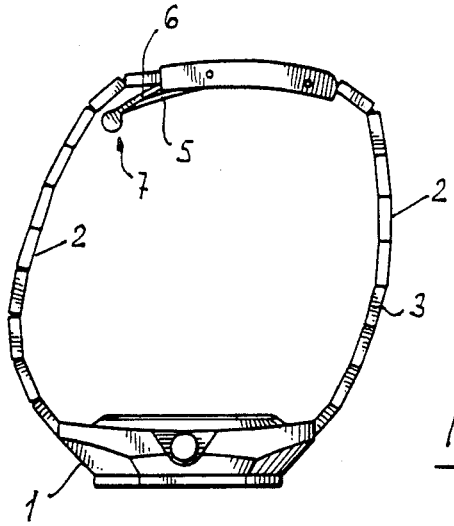

FIGS. 1*a*, 2*a* and 3*a* show a wristwatch bracelet including a so-called folding clasp. Two strands (2) of the bracelet are formed of interconnected links (3) and are attached to a watch (1). The other ends of the bracelet strands (2) are fitted with a folding clasp arrangement comprising at least two parts (5 and 6) in the form of elongated plates. The hinged device according to the invention (7) is located at one end of each of the plates.

FIG. 3*a* shows the bracelet in the closed position, as it is worn around the wrist. The two parts (5 and 6), which display an incurved shape to adapt to the contours of the wrist, are folded over each other and the hinge (7) is attached. FIG. 2*a* shows the bracelet in the open position. The two parts (5 and 6) are fully extended relative to each other to provide greater expansibility to the bracelet so that it can be slipped over the hand. In this instance, the hinge (7) is also attached. Finally, FIG. 1*a* shows the bracelet in a position wherein the parts (5 and 6) are detached from each other by detachment of the hinge (7). To initiate said detachment, the parts (5 and 6) must be positioned at a predetermined angle to each other, in this instance, in the reverse of the position of said parts as shown in FIG. 3*a*. It is apparent that this device enables the bracelet to be detached into two parts for the reasons cited above. Despite this fact, the bracelet nonetheless continues to function as a conventional folding-clasp bracelet, the purpose of which is to prevent it from becoming completely detached and possibly from falling when it is removed from the wrist since it has been demonstrated that the joined parts must be placed in a very specific position before they can be detached, and this specific position is not attained during the process of putting on or removing the bracelet.

Figure 1B:
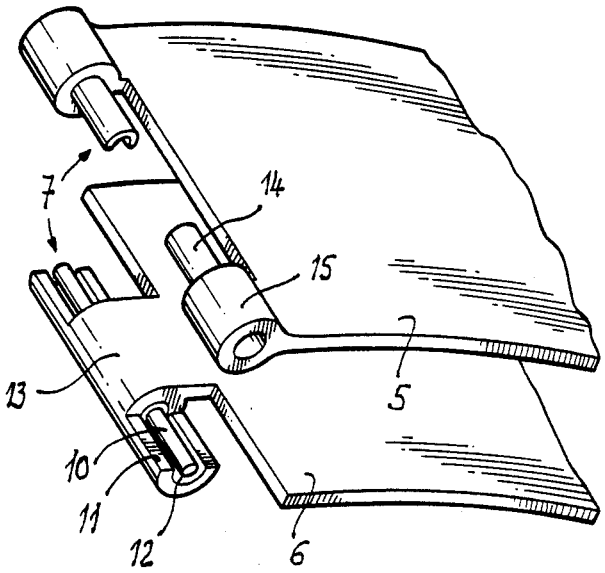
FIG. 1*b* is a perspective drawing of the hinge used to join two parts of the bracelet, the bracelet being shown in the detached position.
Figure 1C:
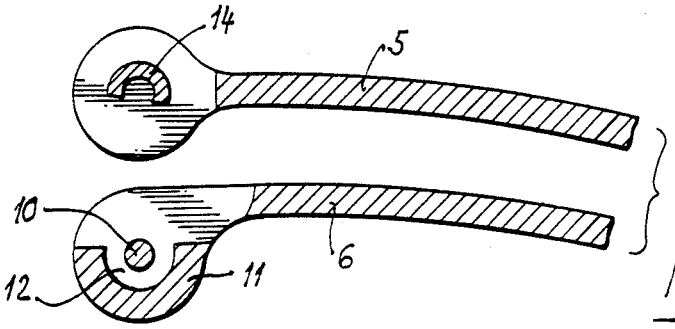
FIG. 1*c* is a cross-section of the hinge in the detached position.
Figure 2B:
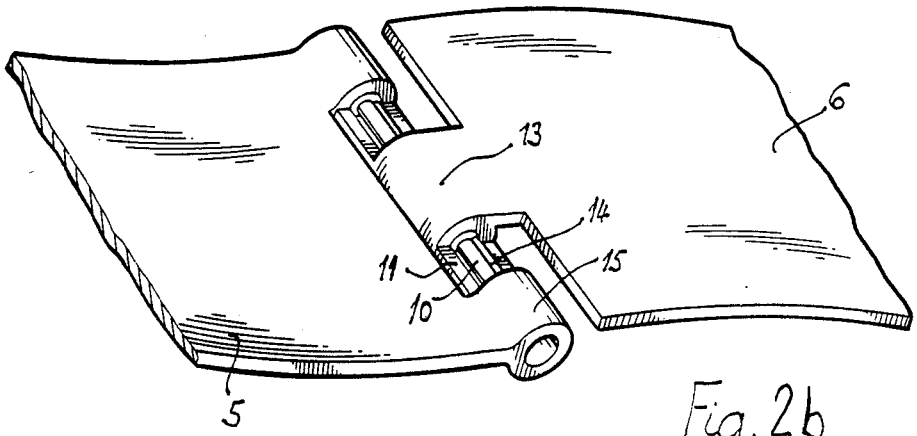
Figure 2C:
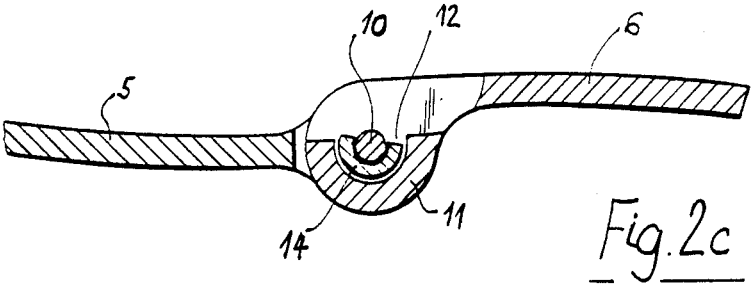
Figure 3B:
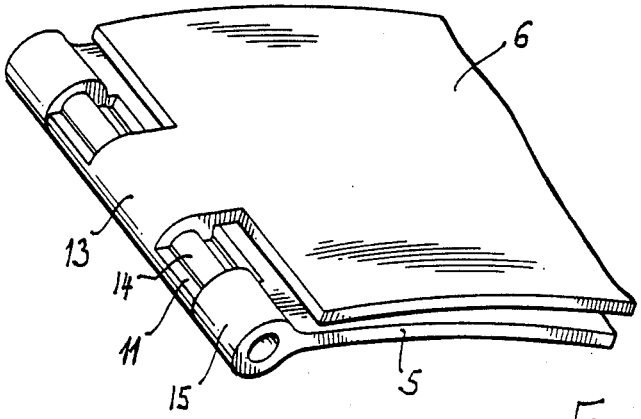
Figure 3C:
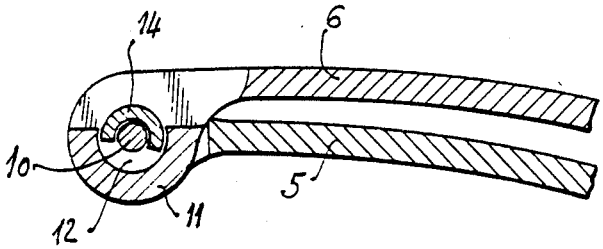

The drawings of FIGS. 1*a*, 2*a* and 3*a* respectively correspond to the drawings of FIGS. 1*b*, 2*b* and 3*b* and to the drawings of FIGS. 1*c*, 2*c* and 3*c*, wherein said drawings are shown in their respective order and shall now be referred to for the purpose of describing the hinge according to this invention.

FIG. 1*b* shows that one part (6) of the bracelet comprises two assemblies, each of which includes a pin (10) and a first cradle (11). The cradle (11) is coaxial with the pin (10) and a space (12) is provided between the two. In this embodiment, the cradle (11) displays the shape of a hollow half-cylinder. Each of the two assemblies formed in this manner is connected to the part (6) by a single center piece (13). The other part (5) of the bracelet comprises two second cradles (14) each of which is connected to the part (5) by a piece (15). The shape of the cradle (14) is designed so that it may be inserted into the space (12), that is, the straight section of the cradle (14) is substantially the same as the straight section of the space (12). In the case illustrated in FIG. 1*b*, the parts (5 and 6) occupy a predetermined angular position wherein they may be inserted into each other. This is the position in which the parts may be attached or detached. FIG. 1*c* is a schematic drawing showing a cross-section through one of the hinges of FIG. 1*b* and more clearly illustrates the process whereby the parts (5 and 6) are fitted together.

When the parts (5 and 6) are attached to each other and part 5 is rotated at an angle of approximately 180°, the position illustrated in FIG. 2*b* is obtained. At the instant when part 5 pivots, the second cradle (14) slides into the space (12) and is joined to the pin (10) so that the hinge is engaged. FIG. 2*b* and FIG. 2*c* (which complements FIG. 2*b*) illustrates the case wherein the elongated plates of the folding clasp are extended end to end, allowing the bracelet to expand to its maximum.

Finally, FIGS. 3*b* and 3*c* illustrate the case wherein the bracelet is completely closed, as when the bracelet is attached to the wrist. In this instance, part 5 has been rotated approximately 360° relative to the position shown in FIG. 1*b* and it is now positioned under part 6, to which it remains attached. In this instance, and as illustrated more specifically in FIG. 3*c*, the hinge nonetheless remains attached, not by the cradle (14) which is no longer within the space (12), but by part 5 which is held in place by part 6.

The advantages of the invention described above are clearly apparent. The detachable hinge does not take up any more space than an ordinary, non-detachable hinge. Because of this, there is no added thickness, as in other bracelets. The hinge disclosed is very easy to use and does not require any spring devices. Finally, it may be implemented in conjunction with existing folding clasp systems, since only the hinge would require modification.

The invention is not limited to a joint connecting two parts, wherein the first part comprises two assemblies, each of which is formed of a pin and a first cradle and the second part comprises two second cradles as shown in the drawings. It is apparent that a simplified embodiment may comprise only a single assembly formed of a pin (10) and a first cradle (11) attached to part 6 and only a single second cradle (14) attached to part 5.

The invention may be applied to plain jewelry bracelets or even to a leather bracelet. It is a particularly welcome addition when a watch is incorporated in such a bracelet.

I claim:

1. A hinge for joining two parts of a bracelet, said hinge comprising:

at least one assembly rigidly affixed to a first of said parts, said assembly comprising a pin and a first cradle, said first cradle having a first concave surface extending arcuately approximately 180 degrees, said first concave surface being disposed coaxially with and partially surrounding said pin but fixed relative to said pin so that there is an arcuate space provided between said pin and said first cradle;

at least one second cradle rigidly affixed to said second part, said second cradle having a second concave surface extending arcuately approximately 180 degrees, said concave surfaces facing each other when said first and second parts are at a predetermined angular position relative to each other whereby said first and second parts may be separated, said second cradle rotating into said arcuate space when said second concave surface is adjacent said pin and one of said first and second parts is rotated relative to the other about the axis of said pin whereby said first and second parts are interlocked by said hinge.

2. A hinge as claimed in claim 1 and further comprising a second assembly fixedly attached to said first part and a further cradle fixedly attached to said second part, said second assembly and said further cradle being like said first assembly and said second cradle, respectively.

3. A hinge as claimed in claim 1, characterized in that the two parts are in the form of two elongated plates designed to be folded over each other and joined to each other in such a way that they can be extended end to end to provide maximum expansion of the bracelet and that, when opened to the greatest angular position, the opposite of the position when the bracelet is closed, said two plates may reach said predetermined angular position thus enabling them to be detached from each other.

4. A hinge as claimed in claim 2, characterized in that the two parts are in the form of two elongated plates designed to be folded over each other and joined to each other in such a way that they can be extended end to end to provide maximum expansion of the bracelet and that, when opened to the greatest angular position, the opposite of the position when the bracelet is closed, said two plates may reach said predetermined angular position thus enabling them to be detached from each other.

5. A watch band comprising two bracelet strands releasably connected to each other by a hinge as defined in claim 1, one of said two parts being non-releasably connected to one of said strands and the other of said two parts being non-releasably connected to the other of said strands.

6. A hinge for joining two parts of a bracelet, said hinge comprising:

a first pin;

a first cradle having a first concave surface;

first means for supporting said pin and said first cradle in fixed relation to a first of said parts, said first means supporting said pin concentrically of said first concave surface whereby an unobstructed space extending over an arc of about 180 degrees exists between said pin and said first concave surface;

a second cradle having a second concave surface extending over an arc of about 180 degrees;

second means for supporting said second cradle in fixed relation to a second of said parts, said second means supporting said second cradle at one end thereof whereby said second cradle may rotate into and fill said arcuate space when said second concave surface is placed on said pin and one of said parts is rotated relative to the other about said pin.

7. A hinge as claimed in claim 6 and further comprising:

a second pin and a third cradle, said first means supporting said second pin and said third cradle at one end coaxially with said first pin and said first cradle;

a fourth cradle; and, third means supporting said fourth cradle coaxially with said second cradle, said third means being rigidly fixed to the second of said parts.

* * * * *